US005931463A

United States Patent [19]

Kaneda

[11] Patent Number: 5,931,463

[45] Date of Patent: Aug. 3, 1999

[54] SORTER AND IMAGE FORMING APPARATUS HAVING THE SAME

[75] Inventor: Hiroshi Kaneda, Ibaraki, Japan

[73] Assignee: Riso Kogaku Corporation, Tokyo, Japan

[21] Appl. No.: 08/855,611

[22] Filed: May 13, 1997

[30] Foreign Application Priority Data

May 13, 1996 [JP] Japan ..... 8-117726

[51] Int. Cl.[6] ..... B65H 39/10

[52] U.S. Cl. ..... 271/296; 271/298; 271/300

[58] Field of Search ..... 271/288, 296, 271/298, 300, 303

[56] References Cited

U.S. PATENT DOCUMENTS 3,937,459 2/1976 Lawrence .
4,408,756 10/1983 Miyashita et al. ..... 271/296 X
4,445,680 5/1984 Kikuchi et al. ..... 271/296 X
4,498,665 2/1985 Watanabe ..... 271/296 X
4,555,106 11/1985 Ruenzi .

*Primary Examiner*—David H. Bollinger
*Attorney, Agent, or Firm*—Sughrue, Mion, Zinn, MacPeak & Seas, PLLC

[57] ABSTRACT

A sorter for sorting a printed sheet discharged from an image forming machine, comprises: a plurality of bins arranged in a vertical direction; a conveyer provided vertically along the plurality of bins to convey the printed sheet vertically downward; an indexer having a guide surface in its upper portion, being vertically movable along a sheet travel route of the conveyer, for peeling the printed sheet off the conveyer with the guide surface and sending the printed sheet in either one of the plurality of bins; a controller connecting to driving the conveyer and the indexer; and a operating panel connecting to the controller, wherein the operating panel receives a printing sheet information of the sheet to be printed and fed the information to the controller, and the controller determines a start position of a working bin out of the plurality of bins in response to the information from the control panel.

8 Claims, 10 Drawing Sheets

SORTER AND IMAGE FORMING APPARATUS HAVING THE SAME

BACKGROUND OF THE INVENTION

The present invention relates to a sheet post-processing unit such as a sorter for distributing and accommodating printed sheets discharged from the image forming machine, and to an image forming apparatus having the sheet post processing unit and an image forming machine such as a copying machine, a printer and the like for forming images on a printing sheet.

Various types of sheet post-processing units for distributing printed sheets which have images formed thereon and discharged from a stencil printing machine have heretofore been developed and put to practical use. Sheet post-processing units of the sorts mentioned above are desired to be devised so that while every possible effort is made for size reduction, a larger number of printed sheet of, for instance papers may be distributable.

In such a sheet post-processing unit of a fixed bin type, a plurality of bins are fixedly arranged in the vertical direction of a casing and conveyer units fitted with fans and blowers are installed in the vertical direction of the plurality of bins and besides indexers as sheet guide means for carrying printed sheets into the corresponding bins are moved up and down vertically along travel routes of the conveyer units. Therefore, an attempt has been made to reduce the size of the whole apparatus by decreasing the dimension thereof in the depth direction. With respect to the conveyer unit, moreover, the diameter of a corner portion at both ends of a belt has also been designed for its size to be minimized. However, the following problems still exist because various types of sheet are used as printing sheet in the stencil printing machine cooperating with aforementioned sheet post-processing unit.

When it is attempted to use the belt for conveying the printed sheet discharged from the stencil printing by means of the sheet post-processing unit thus arranged while the printed sheet is being drawn to the belt, the travel route is largely curved in the corner portion of a belt 94*a* in a belt conveyer unit 94 as shown in FIG. 11.

More specifically, no problem will particularly be caused even though the uppermost bin 78A is first used for accommodating the printed sheet in a case where the printed sheet discharged from the stencil printing machine and conveyed thereto is ordinary paper. Nevertheless, the firm thick printed paper tends to easily peel off the belt 94*a* after it has made a U-turn in the corner portion of the belt 94*a* and passed thereon and it also becomes readily afloat and deviates from the travel route even when a suction unit 96 is employed for drawing the printed paper to the belt. Consequently, the printed paper is conveyed at an acute angle with respect to an indexer 116 as shown by an arrow A of FIG. 11 and caused to strike against the surface of the indexer 116 in a manner sticking therein. Therefore, the printed paper becomes unaccommodated in a target bin 78, which also poses a problem causing a paper jam.

SUMMARY OF THE INVENTION

In view of the foregoing problems, an object of the present invention is to provide an image forming apparatus capable of stably conveying printed sheet which tends to deviate from its travel route, and reducing a paper jam percentage.

In order to accomplish the above and other objects, an image forming system according to the invention comprises:

a plurality of bins arranged in a vertical direction; first conveyer means for conveying printed sheet discharged from the image forming means while air-drawing the printed paper to its belt,; second conveyer means which is provided vertically along the plurality of bins and coupled to the downstream-side portion of the first conveyer means and used for receiving the printed sheet conveyed by the first conveyer means and vertically conveying downward while air-drawing the printed sheet to its belt; printed sheet guide means which has a guide surface in its upper portion, is capable of moving up and down along the sheet travel route of the second conveyer means and used for peeling the printed sheet vertically conveyed downward by the second conveyer means off the belt of the second conveyer means with the guide surface and sending the printed sheet in either one of the plurality of bins; control means for controlling the driving of the first conveyer means, the second conveyer means and the printed sheet guide means in accordance with the printed sheet discharged from the image forming means; and printing sheet information input means for inputting to the control means information on the thickness of printing sheet for use in the image forming means, wherein the control means sets the start position of a working bin out of the plurality of bins in response to the output of the printing paper information input means.

In an image forming apparatus above, the printing sheet information input means may be arranged so that it inputs to the control means a signal which is switched on.off in accordance with the variation of pressure applied to the printing sheet supplied to the image forming means as information on the thickness of the printing sheet.

In an image forming apparatus above, the printing sheet information input means may be arranged so that it inputs to the control means a key signal which is given in accordance with the thickness of the printing sheet as information on the thickness of the printing sheet.

According to another aspect of the present invention, there is provided an image forming apparatus comprising: a plurality of bins arranged in a vertical direction; first conveyer means for conveying printed sheet discharged from the image forming means while air-drawing the printed sheet to its belt; second conveyer means which is provided vertically along the plurality of bins and coupled to the downstream-side portion of the first conveyer means and used for receiving the printed sheet conveyed by the first conveyer means and vertically conveying downward while air-drawing the printed sheet to its belt; printed paper guide means which has a guide surface in its upper portion, is capable of moving up and down along the sheet travel route of the second conveyer means and used for peeling the printed sheet vertically conveyed downward by the second conveyer means off the belt of the second conveyer means with the guide surface and sending the printed paper in any one of the plurality of bins; control means for controlling the driving of the first conveyer means, the second conveyer means and the printed sheet guide means in accordance with the printed paper discharged from the image forming means; and printing sheet information input means for inputting to the control means information on a density of printing paper for use in the image forming means, wherein the control means sets the start position of a working bin out of the plurality of bins in response to the output of the printing sheet information input means.

In an image forming apparatus above, the printing paper information input means may also be arranged so that it inputs to the control means a key signal which is given in accordance with the density of the printing sheet as information on the density of the printing sheet.

According to the present invention, the start position of the working bin is variably controlled according to the information on the thickness of printing sheet such as a printing paper and the like, whereby the printed paper trying to deviate from the travel route can be conveyed stably to the target bin and a paper jam percentage is thus reducible.

DETAILED DESCRIPTION OF THE PREFERRED EMBODIMENTS

Figure 1:
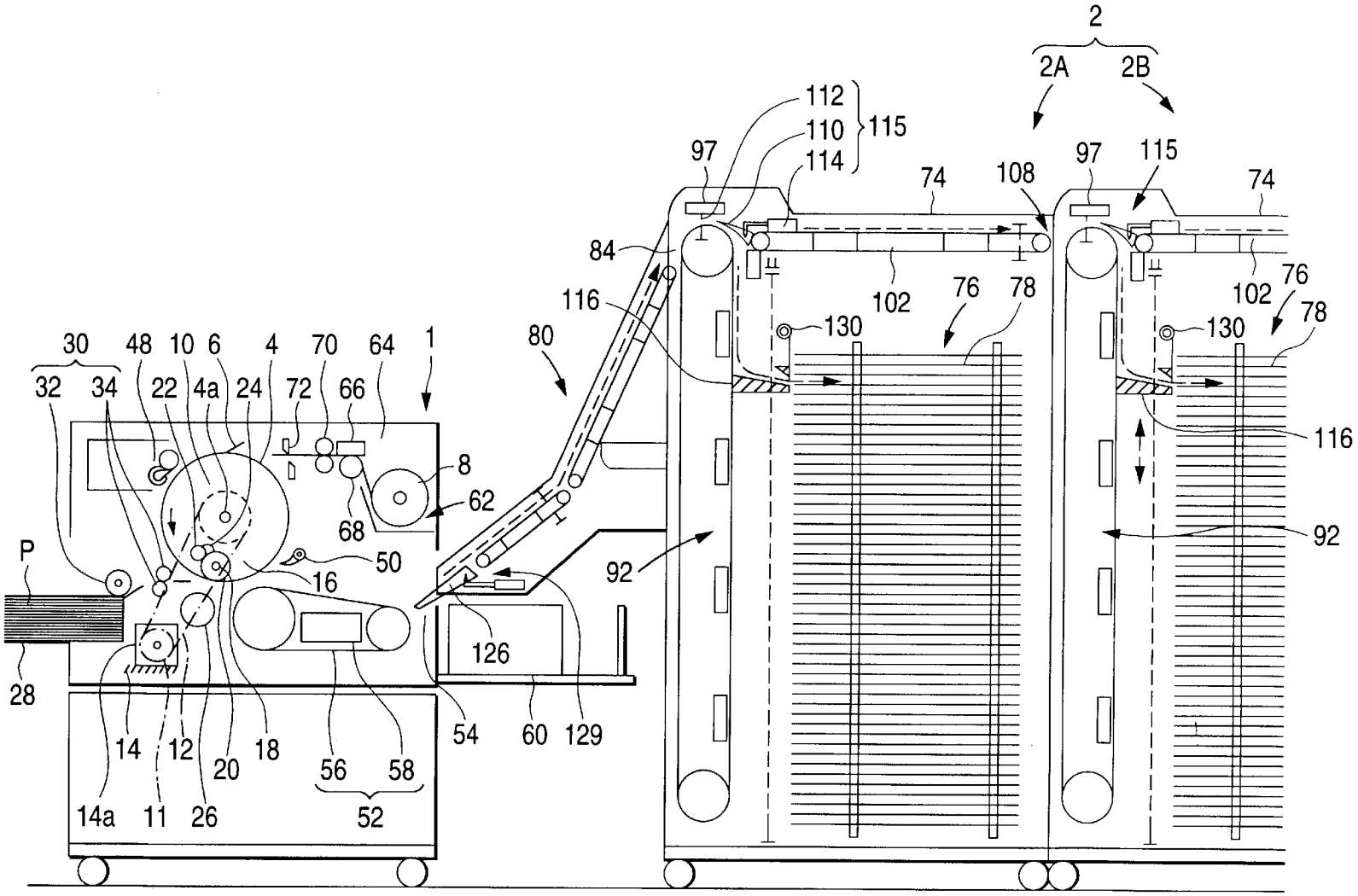
FIG. 1 shows an overall block diagram of an image forming apparatus according to the present invention.

FIG. 1 is an overall block diagram of an image forming apparatus according to the present invention. In this embodiment, the image forming apparatus comprises a stencil printing machine 1 as an image forming machine and a sorter 2 as a sheet post-processing unit.

A description will be given of the construction of the stencil printing machine 1 first. The stencil printing machine 1 has a cylindrical drum 4 rotatably supported with a machine frame (not shown) round the center axis of the cylindrical drum 4. The cylindrical drum 4 is porous in structure and has a clamp mechanism 6 on its outer peripheral portion. The clamp mechanism 6 retains one end of a stencil 8.

The cylindrical drum 4 is coupled to and driven by a sprocket 10 installed in a manner coaxial with the center axis 4*a*. An endless belt 12 is used for coupling the sprocket 10 to the driving sprocket 11 of the drum driving motor 14*a* of a drum driving mechanism 14. The motive power of the drum driving motor 14*a* of the drum driving mechanism 14 works to drive the cylindrical drum 4 to rotate counterclockwise intermittently or continuously.

A printing ink supply means 16 is provided in the body of the cylindrical drum 4. The printing ink supply means 16 is disposed so that its outer peripheral face is brought into contact with the inner peripheral face of the cylindrical drum 4. The printing ink supply means 16 has a squeegee roller 20 capable of rotation round the center axis 18 of the printing ink supply means 16, and a doctor roller 22 extending along the direction of the generating line of the squeegee roller 20 with a predetermined space left with respect to the outer peripheral face of the squeegee roller 20. The printing ink supply means 16 is used for supplying printing ink in an ink reservoir 24 onto the inner peripheral face of the cylindrical drum 4 when the squeegee roller 20 is driven to rotate synchronously in the same direction in which the cylindrical drum 4 rotates.

The printing ink in the ink reservoir 24 is passed through the space between the squeegee roller 20 and the doctor roller 22 as the squeegee roller 20 rotates, when the ink is metered so that a printing ink layer uniform in thickness may be formed on the outer peripheral face of the squeegee roller 20. The printing ink layer is applied to the inner peripheral face of the cylindrical drum 4 for printing purposes as the squeegee roller 20 rotates. A press roller 26 for pressing a printing sheet P against the cylindrical drum 4 installed opposite to the squeegee roller 20 is positioned outside the cylindrical drum 4.

A sheet feed tray 28 for setting the printing sheet P, such as a paper, to be fed between the cylindrical drum 4 and the press roller 26 is installed in a left-hand diagonally-downward position. The sheet feed tray 28 is moved up and down by a driving unit (not shown) in proportion to the quantity of stacked the printing sheets P thus set thereon.

A sheet feed mechanism 30 is positioned in the proximity of the sheet feed tray 28. The sheet feed mechanism 30 has a sheet feed roller 32 made of, for example, rubber and a pair of timing rollers 34. The sheet feed roller 32 picks up the uppermost sheet P to be printed out of those stacked on the paper feed tray 28 one by one and conveys that printing sheet P toward the timing roller side 34. While temporarily holding the printing sheet P conveyed from the sheet feed roller 32 in such a state as to form a predetermined roller-to-roller loop, the timing rollers 34 rotate at predetermined timing in synchronization with the rotation of the cylindrical drum 4 in order to convey the printing sheet P toward the cylindrical drum 4 when the printing operation is performed.

A stencil discharge mechanism 48 is provided round the cylindrical drum 4 and above the sheet feed tray 28. The stencil discharge mechanism 48 is used for peeling off the used stencil sheet wound on the outer peripheral face of the cylindrical drum 4 as the cylindrical drum 4 rotates and for accommodating the stencil sheets discharged. A printed sheet separating pawl 50 is provided round the cylindrical drum 4 and in a position opposite to the sheet feed mechanism 30.

The printed sheet separating pawl 50 is used for removing the printed sheet P subjected to printing from the cylindrical drum 4. The printed sheet P peeled off by the printed sheet separating pawl 50 is conveyed by a sheet discharge unit 52 toward a sheet discharge port 54. The sheet discharge unit 52 has a belt conveyer unit 56 and a suction unit 58; while the printed sheet P peeled by the printed sheet separating pawl 50 off the cylindrical drum 4 is being air-drawn by the suction unit 58, it is conveyed by the belt conveyer unit 56 toward the sheet discharge port 54.

A sheet discharge tray 60 as a stacker unit is installed in the rear of the sheet discharge port 54. In a selected non-sort mode, which will be described later, the sheet discharge tray 60 accommodates the printed sheet P conveyed from the sheet discharge unit 52. A stencil storage unit 62, which is installed above the sheet discharge unit 52, stores the continuous sheet-like stencil 8 wound in the form of a roll.

A making mechanism 64 is installed between the stencil storage unit 62 and the cylindrical drum 4. The making mechanism 64 has a thermal head 66 and a platen roller 68 which is positioned opposite thereto. The making mechanism 64 thermally making the printing stencil supplied from the stencil storage unit 62.

The thermal head 66, though not shown in FIG. 1, has a plurality of heating elements arranged in a line, that is, at fixed intervals in the main scanning direction. The heating elements of the thermal head 66 are arranged so that they selectively generate heat in response to the image information signal read by a read unit (not shown). The printing stencil made up by the making mechanism 64 is conveyed by a stencil conveyer roller 70 toward the cylindrical drum 4. There is also installed a cutter unit 72 between the making mechanism 64 and the cylindrical drum 4, the cutter unit 72 being used to cut the stencil 8 at a point of time the printing stencil has been wound on the outer peripheral face of the cylindrical drum 4 to a desired extent.

A description will subsequently be given of the sorter 2. The sorter 2 has a bin train 76 for accommodating the printed sheets P conveyed from the stencil printing machine 1 in a casing 74 as an outer casing. The sorter 2 is arranged so that its multi-stage connection to the stencil printing machine 1 is made possible. In the example shown in FIG. 1, two sorters 2, namely, a preceding-stage first sorter 2A and a following-stage second sorter 2B, are coupled to the stencil printing machine 1.

Figure 2:
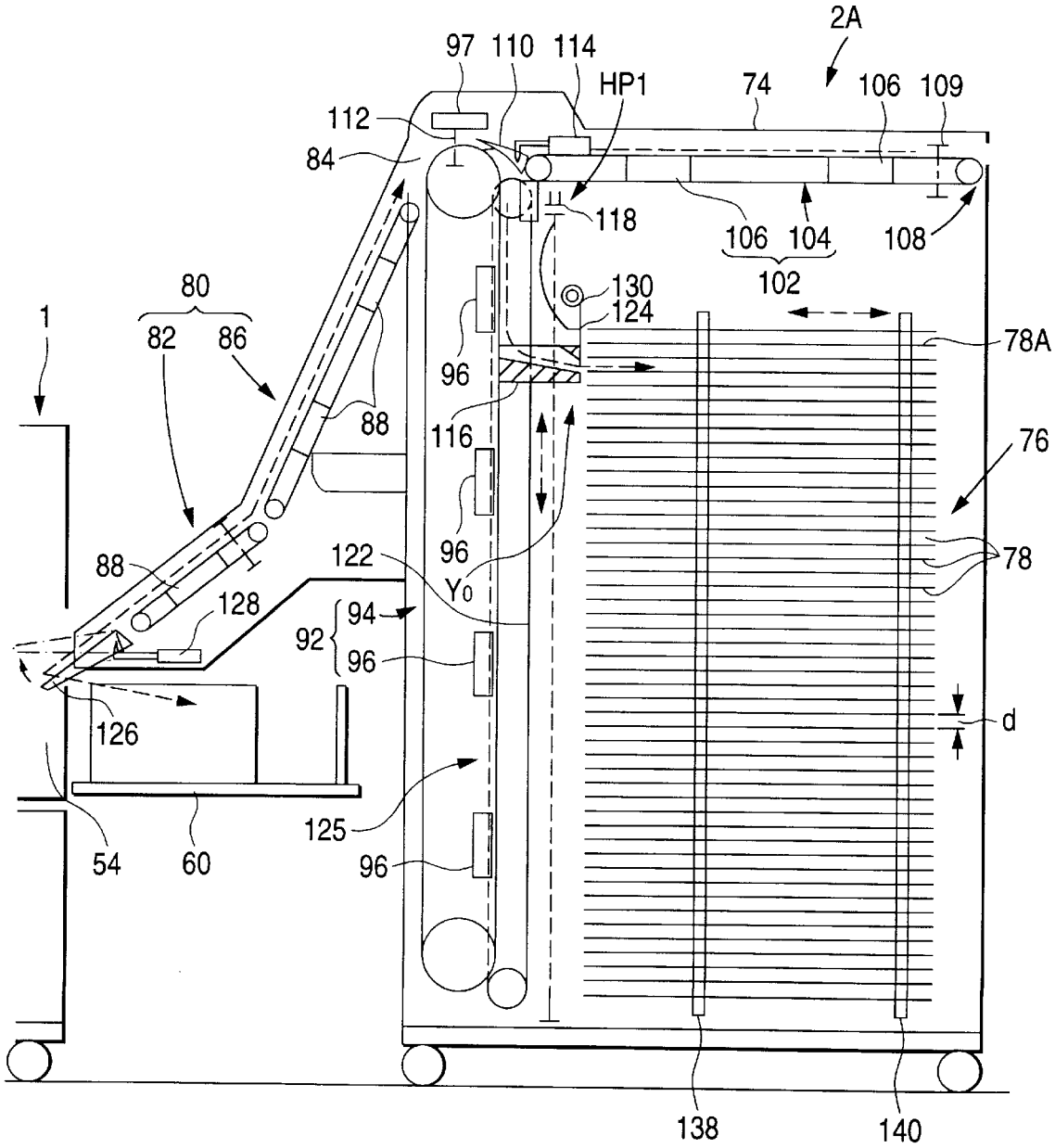
FIG. 2 is an enlarged view of a sorter in the image forming apparatus of the present invention.

The first and second sorters 2A, 2B are similar in construction except that only the first sorter 2A has an approach conveyer mechanism 80, which will be described later. A detailed description will thereupon be given of the construction of only the first sorter 2A by reference of FIG. 2.

The bin train 76 has a plurality of bins 78 which are each formed with similar rectangular plate members. These bins 78 are arranged in layers at predetermined intervals d in the height direction (vertical direction) of the casing 74 and fixed to the rear part of the casing 74 inside.

The approach conveyer mechanism 80 as a first conveyer means for introducing and conveying the printed sheet P from the stencil printing machine 1 into the casing 74 is provided on one side of the casing 74, which side is facing the paper discharge port 54 of the stencil printing machine 1. The approach conveyer mechanism 80 has two belt conveyer units: a preceding-stage belt conveyer unit 82 and a following-stage belt conveyer unit 86.

The belt conveyer units 82, 86 are driven by, for example, DC brushless motors as driving means, respectively. Further, a plurality of suction units 88 in the form of blowers are provided for the respective belt conveyer units 82, 86 at predetermined intervals in the direction in which the printed sheet P is conveyed.

While air-drawing the printed sheet P discharged from the paper discharge port 54 of the stencil printing machine 1 by means of the suction units 88, the preceding-stage belt conveyer unit 82 takes in and conveys the printed sheet P to the following-stage belt conveyer unit 86. While air-drawing the printed sheet P taken in from the preceding-stage belt conveyer unit 82 by means of the suction units 88, the following-stage belt conveyer unit 86 conveys the printed sheet P diagonally upward up to a paper introducing port 84 in the upper end portion of one side of the casing 74.

A bin guide conveyer mechanism 92 as a second conveyer means is provided along the height direction (vertical direction) of the casing 74 under the paper introducing port 84 in the casing 74. Similar to the approach conveyer mechanism 80, the bin guide conveyer mechanism 92 has a belt conveyer unit 94 and suction units 96 and driven by a driving means such as a DC motor. While air-drawing the printed sheet P conveyed from the following-stage belt conveyer unit 86 up to the sheet introducing port 84 by means of the suction units 96, the bin guide conveyer mechanism 92 causes the belt conveyer unit 94 to have the printed sheet P make a U-turn in its curved corner portion and then conveys the printed sheet P downward in the vertical direction of the bin train 76.

Figure 3:
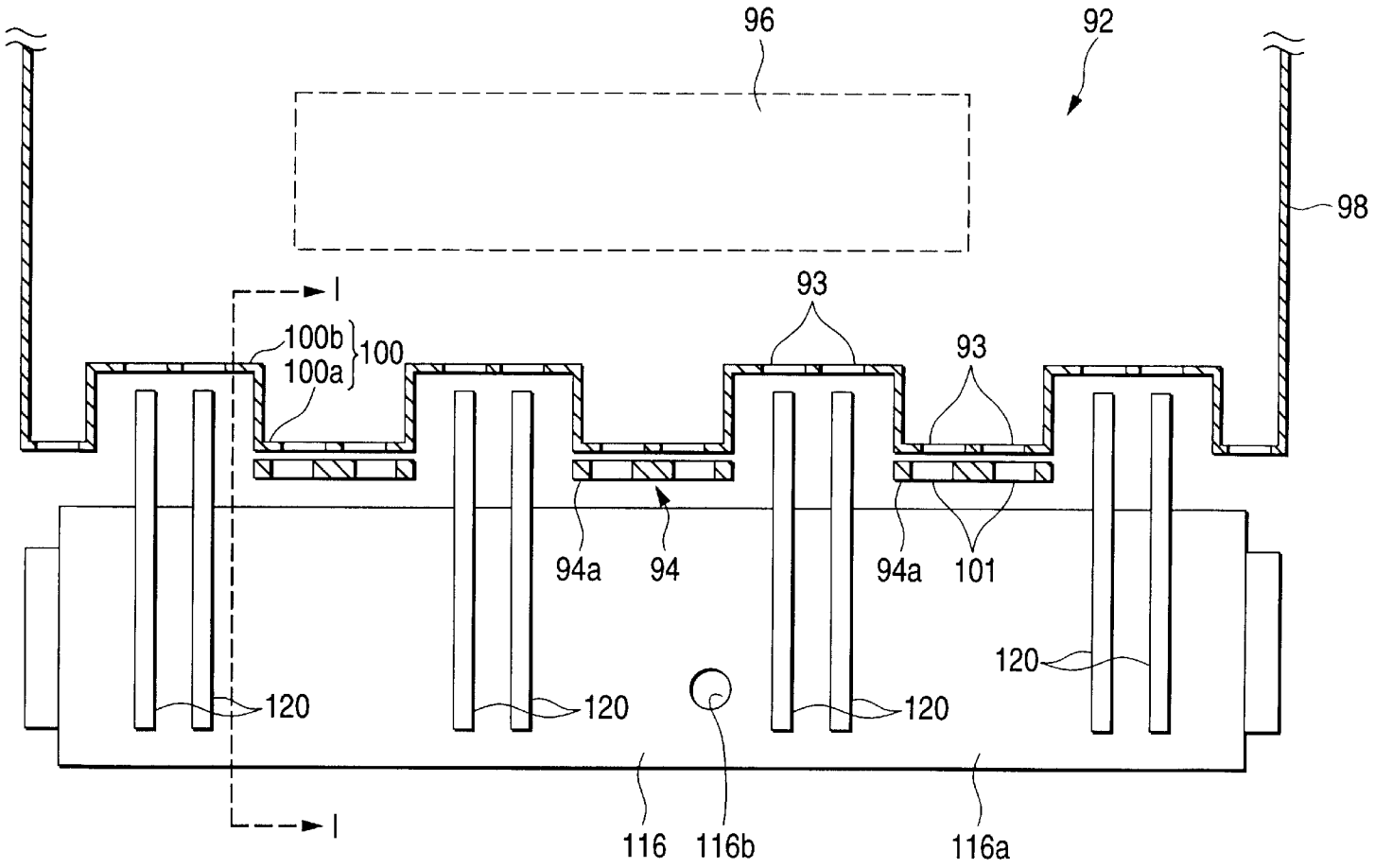
FIG. 3 is a partial enlarged view of a bin guide conveyer unit and an indexer in the image forming apparatus of the present invention.
Figure 4:
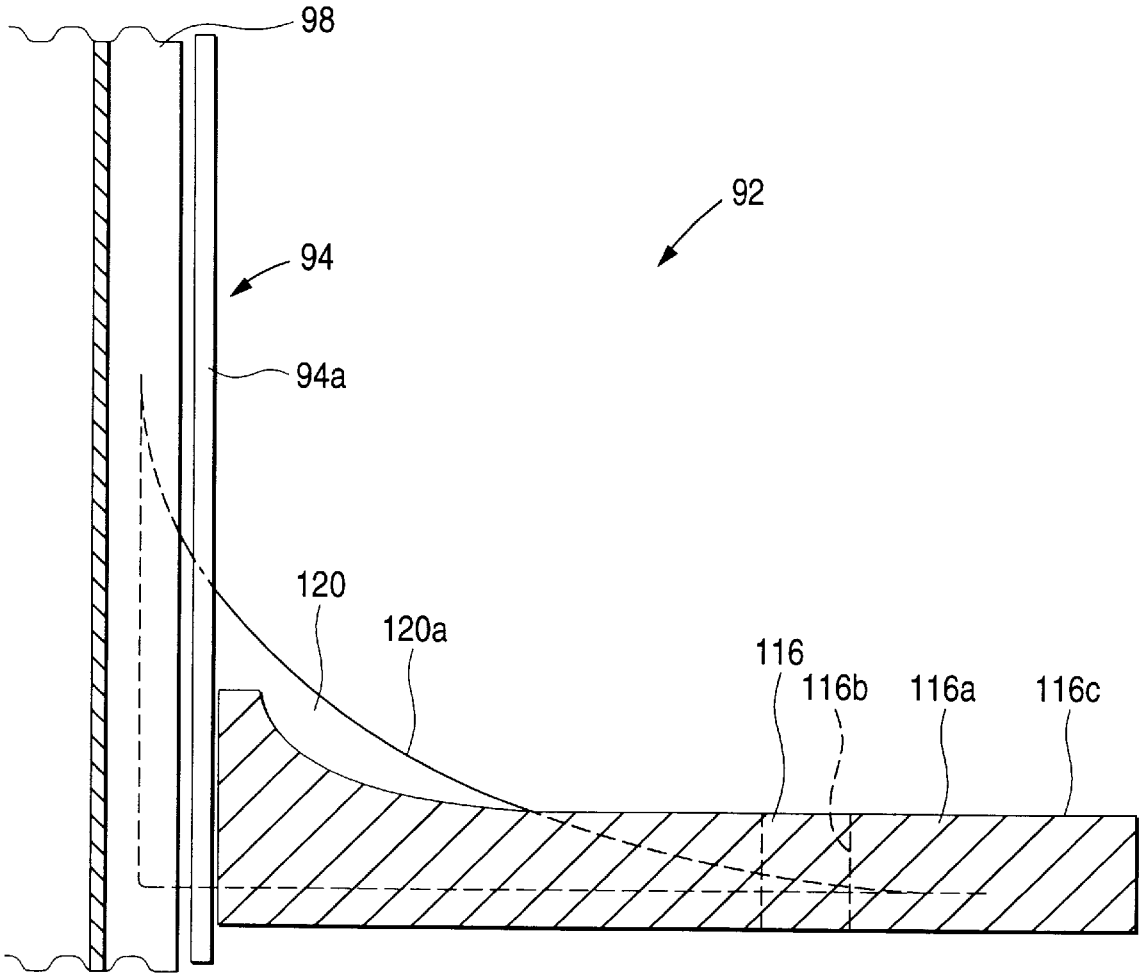
FIG. 4 is a sectional view taken on line I—I of FIG. 3.

FIG. 3 is a partial enlarged sectional view of the bin guide conveyer unit 92 and the indexer 116, which will be described later, as viewed from the upward; and FIG. 4 is a sectional view taken on line I—I of FIG. 3. A comb-like stepped portion 100 is formed in the surface of a frame 98 forming the base of the bin guide conveyer unit 92, so that the printed sheet P is conveyed on the surface thereof. In the stepped portion 100, through-holes 93 for drawing the printed sheet P are formed at predetermined intervals. An endless conveyer belt 94*a* in the belt conveyer unit 94 is provided for each protrusion 100*a* of the stepped portion 100 (actually in three places in this embodiment shown).

Through-holes 101 are formed in the endless conveyer belt 94*a* in positions opposite to the respective through-holes 93 of the protrusion 100*a*. The air-suction force of the suction unit 96 works to air-draw the printed sheet P via the through-holes 93, 101 to the surface of the conveyer belt 94*a* and the printed sheet P is conveyed in such a state that it is kept sticking to the surface of the conveyer belt 94*a*.

A fan 97 as a blower for pressing the printed sheet P conveyed from the approach conveyer mechanism 80 against the surface of the belt and for sticking the printed sheet P thereon is installed in the proximity of the outer periphery of the top portion of the belt conveyer unit 94.

A sorter passage conveyer mechanism 102 for conveying the printed sheet P to the second sorter 2B connected to the preceding stage is installed above the bin train 76. Similar to the approach conveyer mechanism 80 and the bin guide conveyer mechanism 92, the sorter passage conveyer mechanism 102 has a belt conveyer unit 104 and a suction unit 106 and driven by, for example, a DC motor as a driving means.

While air-drawing the printed sheet P conveyed by the following-stage belt conveyer unit 86 up to the sheet introducing port 84 by means of the suction units 106, the sorter passage conveyer mechanism 102 discharges the printed sheet P from a sheet discharge port 108 in the upper end portion of the other side face of the casing 74 by means of the belt conveyer unit 104 and conveys the printed sheet P up to the sheet introducing port 84 of the second sorter 2B. Incidentally, the sorter passage conveyer mechanism 102 is unnecessary when only one sorter 2 is connected to the stencil printing machine 1.

A sheet passage sensor 109 is installed on the exit side of the belt conveyer unit 104 in the sorter passage conveyer mechanism 102. The sheet passage sensor 109 detects the presence or absence of the passage of the printed sheet P conveyed on the belt conveyer unit 104 before being introduced into the paper introducing port 84 of the second sorter 2B from the paper discharge port 108.

A sorter switching plate 110 is installed in the proximity of the sheet introducing port 84 on the entrance side of the sorter passage conveyer mechanism 102. A sorter switching sensor 112 is installed in the proximity of the sheet introducing port 84 on the entrance side of the sorter switching plate 110. The sorter switching sensor 112 is used for detecting the printed sheet P introduced into the paper introducing port 84 from the approach conveyer mechanism 80 and conveyed therethrough.

The sorter switching plate 110 is switched under the control of a solenoid 114 which is turned on and off in conformity with not only the number of printed sheet P conveyed to the preceding-stage first sorter 2A connected to the stencil printing machine 1 but also the set mode. In this case, the sorter switching plate 110, the sorter switching sensor 112 and the solenoid 114 constitute a sorter switching mechanism 115.

In the space between the bin train 76 and the bin guide conveyer mechanism 92 lies the indexer 116 for causing the printed sheet P to be inserted in the predetermined bin 78 of the bin train 76. As shown in FIGS. 3–4, the indexer 116 has a rectangular support portion 116*a* substantially equal in width to the bin 78 and remains on standby in the home position HP1 set in a position slightly above the uppermost bin 78 (78A) initially. An indexer HP sensor 118 for detecting the presence or absence of the indexer 116 is installed in the home position HP1.

Plate-like guide members 120 incorporated in the surface of the support portion 116*a* of the indexer 116 are formed at predetermined intervals in the width direction of the support portion 116*a*. In the example of FIG. 3, four sets of guide members 120 with two of them as a pair are provided. The guide members 120 are uprightly provided in a position corresponding to the recess 100*b* of the frame 98 of the bin guide conveyer unit 92. The surface of the guide member 120 forms a guide plane 120*a* curving downward from the leading end close to the bin guide conveyer unit 92 up to the trailing end thereof. Further, the leading end portion of the guide member 120 is situated within a recess 100*b* of the stepped portion 100.

The indexer 116 is such that both ends of its support member 116*a* are connected via a driving belt 122 to a driving means such as a DC servo motor. A columnar through-hole 116*b* is formed in a substantially central position of the support member 116*a* of the indexer 116. An indexer sensor 124 formed with a transmission type photosensor is installed in upper and lower positions in the vertical direction of the casing 74 in a manner holding the through-hole 116*b* therebetween. The indexer sensor 124 is used for detecting the printed sheet P passed on the guide plane 120*a* of the indexer 116, monitoring the situation in which printed paper is unarriving or stagnant on the guide plane 120*a* of the indexer 116 and also detecting a jam error. In this case, the indexer 116, the driving belt 122 and the indexer sensors 124 constitute an indexer elevating mechanism 125. Incidentally, the indexer sensor 124 may be replaced with a photo-interrupter, which is provided for the indexer 116 and used for detecting the sheet paper P passed on the guide plane 120*a* of the indexer 116.

When the indexer 116 is driven by the DC servo motor as the driving means via the driving belt 122, the tip of the printed sheet P conveyed by the bin guide conveyer unit 92 is peeled off the conveyer belt 94*a* with the tips of the guide members 120, whereby the printed sheet P is received on the guide plane 120*a*. When the indexer sensor 124 detects that the printed sheet P has been accommodated in the bin train 76 for certain, the indexer 116 is made to move by the bin-to-bin 78 pitch with the home position HP1 as a reference position. The printed sheet P is thus inserted in each corresponding bin 78 of the bin train 76 one by one.

A switching plate 126 is installed on the entrance side of the preceding-stage belt conveyer unit 82 in the approach conveyer mechanism 80. The switching plate 126 is so controlled as to be switched when a solenoid 128 is turned on or off in according with the set mode. More specifically, the switching plate 126 is switched so that the printed sheet P is conveyed to the sheet discharge tray 60 of the stencil printing machine 1 when the non-sort mode has been set. On the other hand, the switching plate 126 is switched so that the printed sheet P is conveyed to the first sorter 2A when the mode of using the second sorter 2B has been set. In this case, the switching plate 126 and the solenoid 128 constitute a switching mechanism 129.

A sheet member 130 which is wound in the form of a roll is installed in a position right above the introduction end side of the uppermost bin 78A. One end of the sheet member 130 is fixedly secured to the casing 74 and the other end of the sheet member 130 as an open end is fastened to the indexer 116. The sheet member 130 operates to pay out and wind up the sheet, which operation is interlocked with the upward and downward movements of the indexer 116 and also prevents rebounding due to the sub-scan matching board 140 of a matching mechanism 136, which will be described later, when the printed sheet P is accommodated in the bin 78. Incidentally, the bin-side surface of the sheet member 130 is made a reference matching plane $Y_0$ in the sub-scan direction when the sub-scan direction of the printed sheet P inserted in the bin 78 is matched.

In each of the bins 78 constituting the bin train 76, cut portions 132, 134 having predetermined lengths are formed along the direction (sub-scan direction) in which the printed sheet P inserted from the indexer 116 is conveyed and the direction (main scan direction) perpendicular to the direction in which the printed sheet P is conveyed, respectively. Further, a matching mechanism 136 for matching the printed sheet P inserted in the bin 78 with predetermined reference matching faces is provided in the positions corresponding to the cut portions 132, 134.

Figure 5:
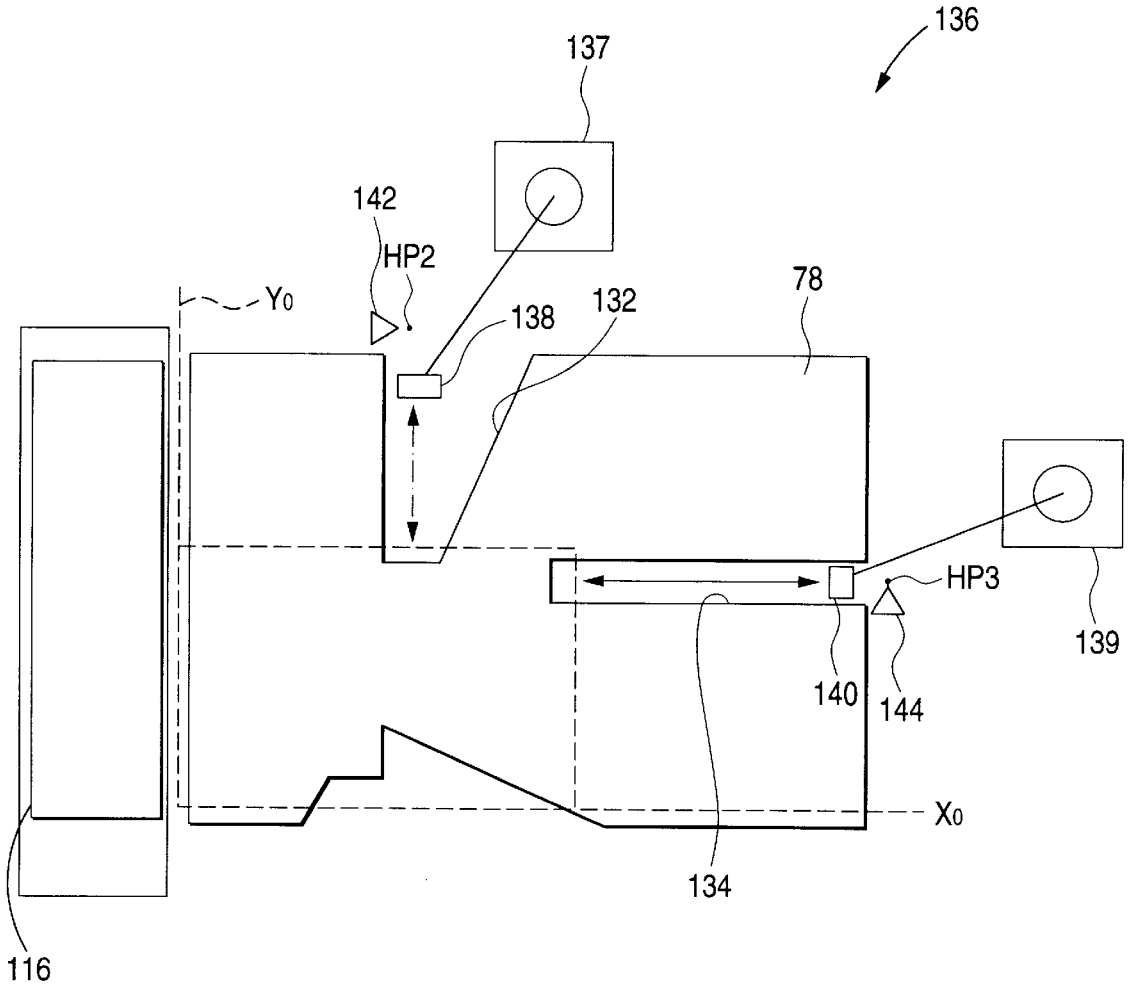
FIG. 5 is a plan view of a matching mechanism in the image forming apparatus of the present invention.

FIG. 5 is a plan view of the matching mechanism 136. The reference matching planes $X_0$, $Y_0$ are set at the left lower corner of FIG. 5. More specifically, the reference matching plane $Y_0$ in the sub-scan direction is set on the bin-side surface of the sheet member 130 as described above, whereas the reference matching plane $X_0$ in the main scan direction is set on the inner wall surface of a cover member which can be opened and closed with respect to the casing 74, so that the cover member is made openable when the printed sheet P in the bin 78 is taken out.

The matching mechanism 136 has a main scan matching plate 138 which is moved in the main scan direction within the cut portion 132 extending in a direction perpendicular to the direction in which the printed sheet P is conveyed, and a sub-scan matching plate 140 which is moved in the sub-scan direction within the cut portion 132 extending therein.

The outermost position of the cut portion 132 is set to a main scan home position HP2 as a stand-by reference position when the main scan matching plate is moved. A main scan HP sensor 142 is installed in the proximity of the outermost position of the cut portion 132, for detecting whether or not the main scan matching plate 138 is positioned at the main scan home position HP2.

Similarly, the outermost position of the cut portion 134 is set to a sub-scan home position HP3 as a stand-by reference position when the sub-scan matching plate is moved. A sub-scan HP sensor 144 for detecting whether or not the sub-scan matching plate 140 is provided at the sub-scan home position HP3 is installed in the proximity of the outermost position of the cut portion 134. The main scan matching plate 138 and the sub-scan matching plate 140 are connected to, for example, pulse motors 137, 139 as driving means, respectively.

In other words, the main scan matching plate 138 is moved in the main scan direction by the pulse quantity with the main scan home position HP2 as a reference when the pulse quantity of the pulse motor as the driving means is determined according to preset sheet main-scan data in conformity with the size of printing sheet. Moreover, the sub-scan matching plate 140 is moved in the sub-scan direction by the pulse quantity with the sub-scan home position HP3 as a reference when the pulse quantity of the pulse motor as the driving means is determined according to preset sheet sub-scan data in conformity with the size of printing sheet.

Thus, the main scan matching plate 138 and the sub-scan matching plate 140 are moved in conformity with the size of the printing sheet, whereby the printed sheet P inserted in each bin 78 of the bin train 76 from the indexer 116 is matched with the reference matching planes $X_0$, $Y_0$.

The size of printed sheet that can be accommodated in each bin 78 is restricted by the positional relation between the two matching plates 138, 140 and the positional relation between the HP sensors 142, 144 of the matching plates 138, 140. In other words, the minimum size of printed sheet that can be accommodated in the bin 78 becomes what is defined by moving the two matching plates 138, 140 as much as possible from the home positions HP2, HP3 up to a position where the matching plates 138, 140 do not interfere with each other. Further, the maximum size of printed sheet that can be accommodated in the bin 78 becomes what allows the printed sheet to be accommodated therein without its interference with either HP sensor 142 or 144.

The stencil printing machine 1 and the sorter 2 thus arranged are connected together by mounting the approach conveyer mechanism 80 on the paper discharge port 54 of the stencil printing machine 1. The operation of distributing and accommodating printing sheets in the bin train 76 of the sorter 2 is performed through pressing specific keys provided on the operating panel 146 of the stencil printing machine 1 as will be described below.

Figure 6:
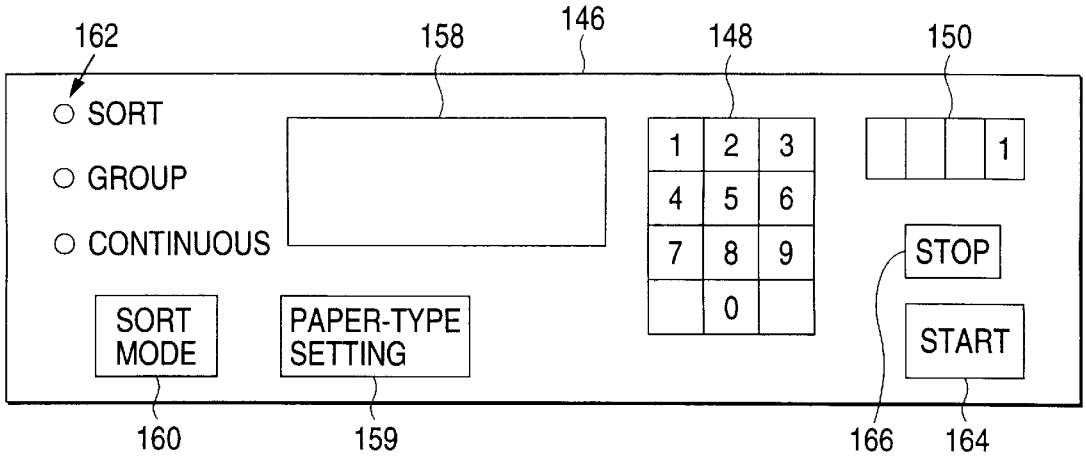
FIG. 6 is a diagram illustrating an operating panel which is installed in a stencil printing machine of the image forming apparatus of the invention.

FIG. 6 shows an operating panel mounted on a stencil printing machine. The operating panel 146 is provided with a ten key pad 148, a number-of-sheets LED 150, a display 158 such as a liquid crystal panel, a paper-type setting mode key 159, a sort mode key 160, a mode LED 162, a start key 164 and a stop key 166.

The ten key pad 148 includes number keys 0–9, which are used for setting the number of printing sheets and dimensions in the main scanning and sub-scanning directions of free size in a user mode.

The number-of-sheets LED 150 displays the number of sheets set through the ten key pad 148. The value displayed by the number-of-sheets LED 150 is decremented by one each time the printed sheet P is discharged synchronously during the printing operation performed by the stencil printing machine 1.

Figure 7:
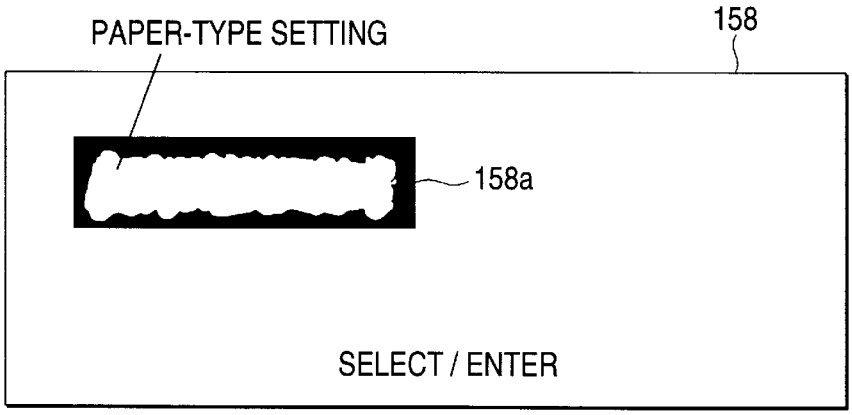
FIGS. 7(*a*) and 7(*b*) are diagrams showing examples of display screens when different types of printing sheet are set in the image forming apparatus of the invention.
Figure 7:
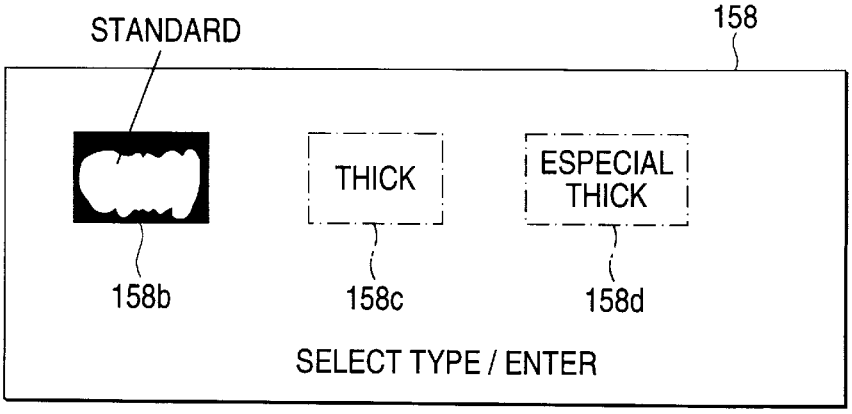

When the paper-type setting mode key 159 is pressed, the display 158 displays a paper-type inputting screen in order to determine the start position of the working bin 78. More specifically, an input display screen for displaying a paper-type setting key 158*a* as a software key shown in FIG. 7(*a*) appears instead through the operation of the paper-type setting mode key 159. When the paper-type setting key 158*a* is depressed, the screen is switched over to what displays keys 158*b*, 158*c*, 158*d* as software keys for respectively displaying different paper types of printing sheet (for example, three types of 'standard', 'thick paper' and 'especially thick paper') as shown in FIG. 7(*b*). In addition, the display 158 displays an error indication when an error such as a jam occurs, the size of printing sheet P detected by the sheet feed mechanism 30 and the like.

The paper-type setting mode key 159 is pressed in case that a mode for changing the start position of the working bin 78 in accordance with the thickness of printing paper P to be used in the stencil printing machine 1 is to be selected.

The sort mode key 160 is pressed when one of the following modes is selected: a non-sort mode in which the printed sheet P is accommodated by using the sheet discharge tray 60, one of the three modes (a sort mode, a group mode and a continuous mode) in which the printed sheet P is accommodated by using the sorter 2. The sort mode key 160 is used for sequentially switching the following modes each time it is pressed after the operating panel is supplied with power: namely, from non-sort mode to sort mode, group mode, continuous mode and non-sort mode in a loop.

The non-sort mode refers to a mode in which the printed sheet P discharged from the paper discharge port 54 of the stencil printing machine 1 is directly discharged onto the sheet discharge tray 60.

The sort mode refers to a mode in which the printed sheet P discharged from the paper discharge port 54 of the stencil printing machine 1 are page-to-page accommodated in the bins 78 in order to gather the plurality of pages into printed matter.

The group mode refers to a mode in which the printed sheets P discharged from the sheet discharge port 54 of the stencil printing machine 1 are sorted into groups on a manuscript basis before being accommodated in the bins 78, which makes it possible to sort the printed papers into combinations of number of sheets x number of sets' on that manuscript basis.

The continuous mode refers to a mode in which the printed sheets P discharged from the sheet discharge port 54 of the stencil printing machine 1 are distributed to and accommodated in each bin 78 by one sheet at a time so as to reduce the back printing of printed matter.

The mode LED 162 displays the mode (the sort mode, the group mode or the continuous mode) selected by the sort mode key 160. In a case where the mode LED 162 displays nothing, the non-sort mode has been selected.

The start key 164 is pressed when the operation of the stencil printing machine 1 and the sorter 2 is to be performed. The stop key 166 is pressed when the operation of the stencil printing machine 1 and the sorter 2 is to be stopped.

Figure 8:
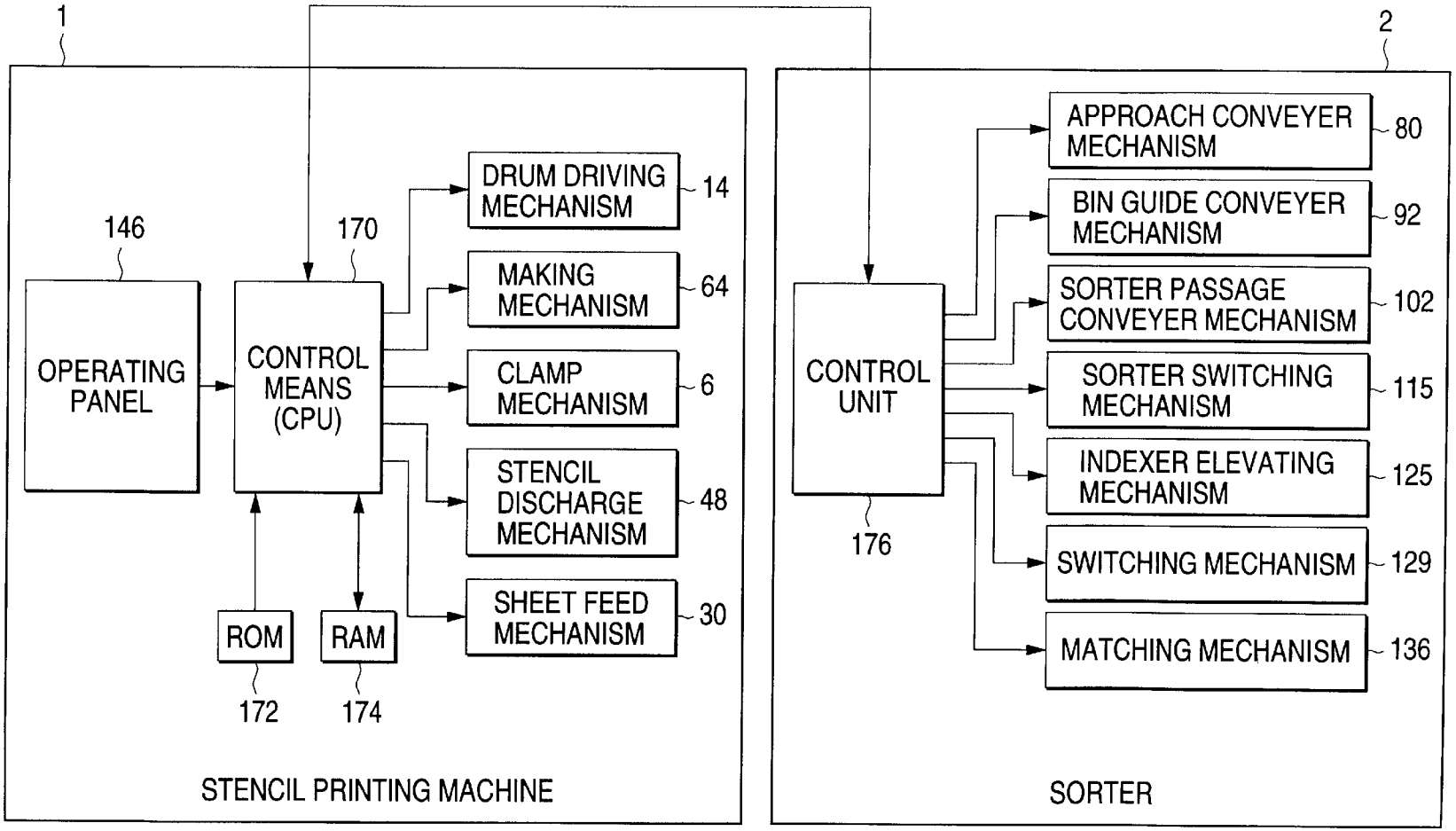
FIG. 8 is a block diagram illustrating an electrical arrangement in the image forming apparatus according to the invention.

FIG. 8 is a block diagram illustrating an electrical arrangement of the aforesaid image forming apparatus. In FIG. 8, a control means (CPU) 170 such as a microprocessor is used for controlling each of the mechanisms in the apparatus according to the program stored in a ROM 172.

A RAM 174 for storing information fed from the operating panel 146 is connected to the control means 170, the information including the number of printing, free size at the time the user mode is set, various sort modes and the like.

The control means 170 is used for controlling the rotation of the cylindrical drum 4 by issuing a rotation command to the drum driving mechanism 14. The control means 170 also issues to the making mechanism 64 a command of making up the stencil 8, to the clamp mechanism 6 a command of retaining/releasing the stencil 8 by/from the cylindrical drum 4, to the stencil discharge mechanism 48 a command of peeling the used stencil 8 off the cylindrical drum 4, and to the sheet feed mechanism 30 a command of performing the operation of feeding the printing sheet P, which operation is interlocked with the drum driving mechanism 14.

As shown in FIG. 8, a control unit 176 for controlling the operation of each mechanism of the sorter 2 is provided on the sorter side. This control unit 176 and the control means 170 of the stencil printing machine 1 are electrically connected via a cable or the like, so that control information is exchanged therebetween. The control unit 176 is used for synchronously controlling the operation of the sorter 2 for successively taking in the printed sheets P discharged one by one from the stencil printing machine 1 according to the control commands from the control means 170 under the control thereof.

When an error occurs on the part of the sorter 2, the control unit 176 notifies the occurrence of such an error to the control means 170 and deals with the error according to control instructions from the control means 170.

Consequently, the control unit 176 issues control commands to the approach conveyer mechanism 80, the bin guide conveyer mechanism 92, the sorter passage conveyer mechanism 102, the sorter switching mechanism 115, the indexer elevating mechanism 125, the switching mechanism 129, the matching mechanism 136 and the like in the sorter 2.

Under the command issued to each mechanism, the printed sheets P discharged from the stencil printing machine 1 are sorted out and accommodated in the corresponding bins 78 of the sorter 2 in conformity with the set mode.

Although it has been arranged that the operating panel 146 is installed on the stencil printing machine side 1, a similar operating panel may be installed on the sorter side 2 so as to send set contents resulting from the operation of that operating panel to the control means 170 of the stencil printing machine 1. Moreover, the operating panels 146 may be installed in both stencil printing machine 1 and sorter 2.

Figure 9:
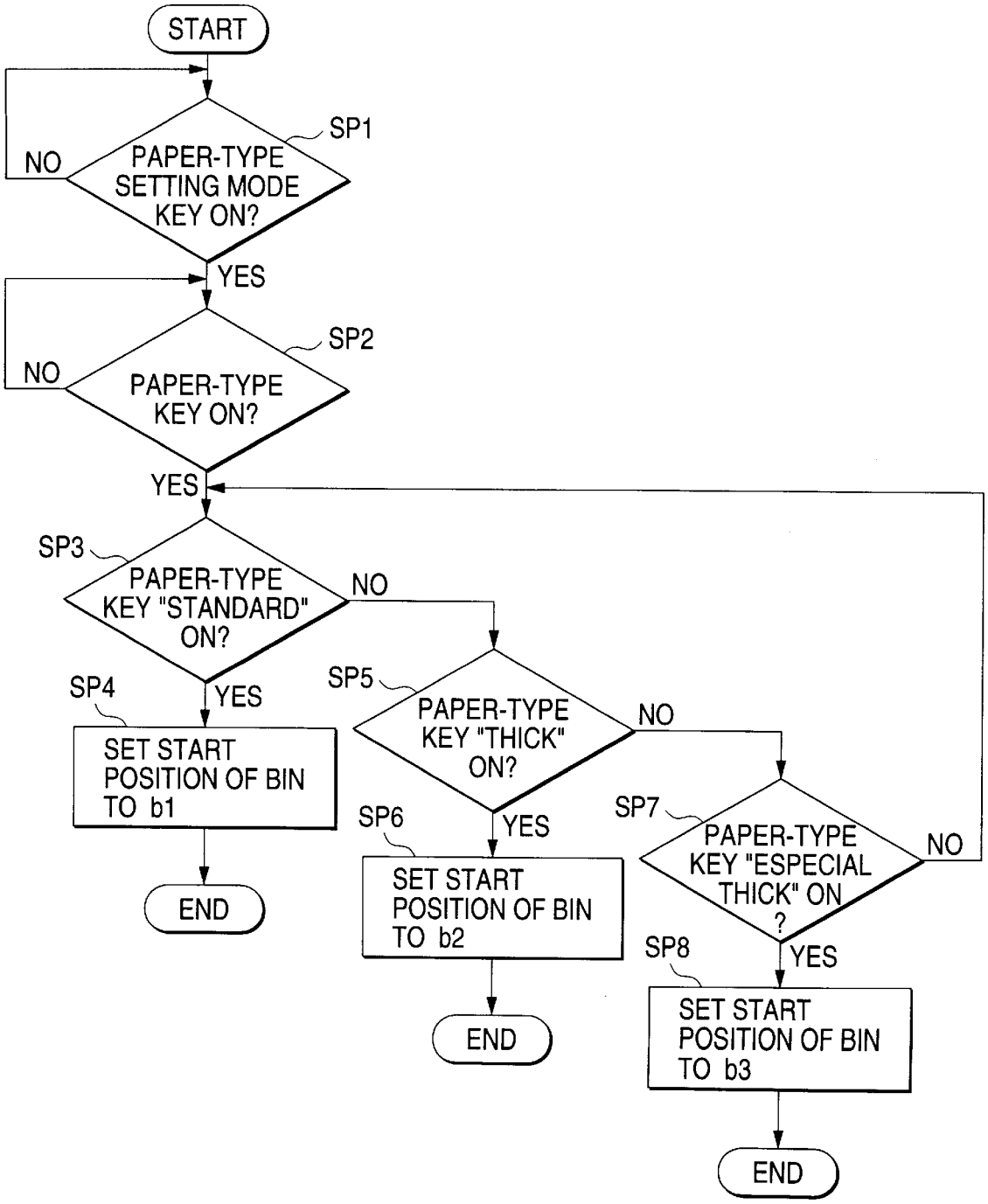
FIG. 9 is a flowchart showing a method of setting the start position of the working bin in the image forming apparatus of the invention.

In the image forming system thus arranged, the start position of the working bin as shown in a flowchart of FIG. 9 prior to the distribution of the printed sheets P discharged from the stencil printing machine 1 in conformity with the respective modes.

When the paper-type setting mode key 159 of the operating panel 146 is pressed first (SP1-Yes), the mode is switched over to what is for setting the start position of the working bin 78. The display 158 changes to an input display screen displaying the paper-type setting key 158*a* as shown in FIG. 7(*a*). When the paper-type setting key 158*a* is depressed (SP2-Yes), the screen is switched over to what displays three kinds of keys 158*b*, 158*c*, 158*d* respectively displaying 'standard', 'thick paper' and 'especially thick paper' as shown in FIG. 7(*b*).

When the key 158*b* representing 'standard', with the total number of bins set to 50, for example, is depressed (SP3-Yes), the control means 170 (or the control unit 176) sets the start position of the working bin 78 to the uppermost position b1 (a first bin from above) (SP4) according to the output. When the key 158*c* representing 'thick paper' is depressed (SP5-Yes), the control means 170 (or the control unit 176) sets the start position of the working bin 78 to the position b2 of a fifth bin from the uppermost side (SP6) according to the output. When the key 158*d* representing 'especially thick paper', is depressed (SP7-Yes), the control means 170 (or the control unit 176) sets the start position of the working bin 78 to the position b3 of a tenth bin from the uppermost side (SP8) according to the output.

When the setting of the start position of the working bin 78 is completed in accordance with the thickness of printing paper P for use in the stencil printing machine 1, the sort printing operation is made performable hereafter. Then the mode switching plate 126 is switched over to the sorter side and so is the sorter switching plate 110 to the bin guide conveyer unit side 86, whereby the printed paper P discharged from the stencil printing machine 1 is conveyed via the approach conveyer mechanism 80 up to the bin guide conveyer unit 86.

When the printed sheet P is guided and conveyed by the bin guide conveyer unit 86 up to the indexer 116, the indexer 116 is moved by the bin-to-bin 78 pitch with the home position HP1 as a reference position. Thus the printed sheet P is inserted in each corresponding bin 78 one by one.

While the start position of the working bin 78 in accordance with the thickness of the printed sheet P is set through the operation of the operating panel 146, the indexer 116 is so controlled by the control unit 176 as to move up to the start position of the working bin 78 with the home position HP1 as the reference and to move by the bin-to-bin 78 pitch with the start position as a starting point. In other words, with the thickness of the paper being 'standard,' the start position b1 set by depressing the paper-type key 158*b* becomes the starting point of the indexer 116. With the thickness of the paper being 'thick,' the start position b2 set by depressing the paper-type key 158*c* becomes the starting point of the indexer 116. With the thickness of the paper being 'especially thick,' the start position b3 set by depressing the paper-type key 158*d* becomes the starting point of the indexer 116.

When printing paper for use in the stencil printing machine 1 is thick or especially thick, the start position of the working bin 78 is thus set to the position b2 or b3, which is lower by the predetermined number of bins than the standard. When the thick or especially thick printing paper P is conveyed from the sheet introducing port 84 to the bin guide conveyer mechanism 92, the indexer 116 is so controlled as to move to the position lower by the predetermined steps than the uppermost bins 78A; that is, up to the position b2 or b3 set in conformity with the thickness of printing paper P for use in the stencil printing machine 1.

Therefore, even though the printed sheet P deviates from the travel route when it makes a U-turn in the curved corner portion of the bin guide conveyer mechanism 92 and passes thereon, it is drawn by the suction unit 96 of the bin guide conveyer mechanism 92 and returns to the travel route.

Figure 11:
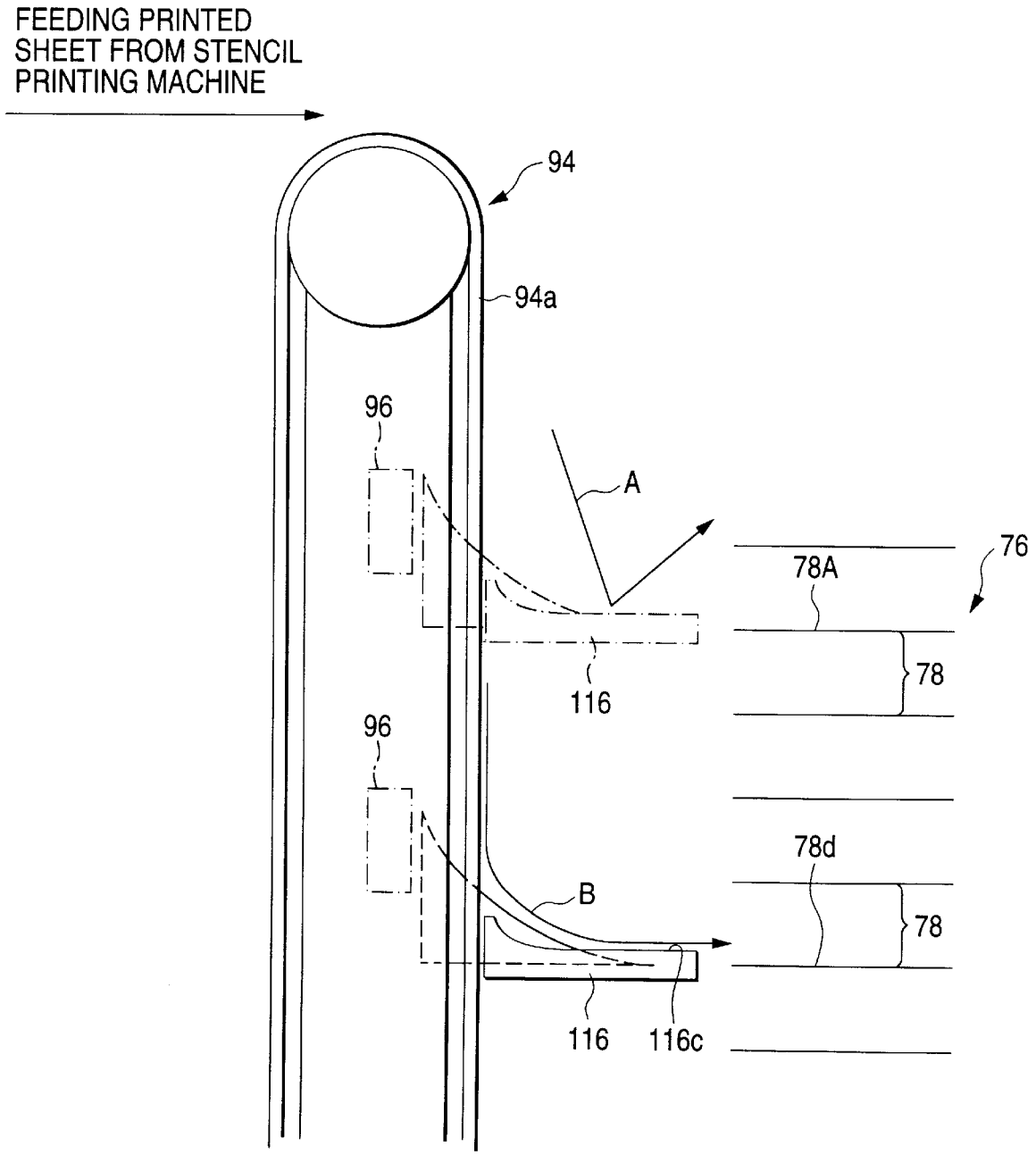
FIG. 11 is a diagram illustrating an ideal and an abnormal state in which printed paper is conveyed.

Consequently, the printed sheet P is inserted in the target bin 78 via the guide member 120 of the indexer 116 as shown by an arrow B of FIG. 11 without being delivered to the indexer 116 at an acute angle as shown by the arrow B thereof.

Unless the start position of the working bin 78 is especially set, the indexer 116 is so controlled as to move by the bin-to-bin 78 pitch with the home position HP1 as the reference position in a manner making the surface 78*d* of the bin 78 correspond to the surface 116*c* of the downstream-side end portion of the indexer 116.

The indexer 116 in the sorter 2 is moved to a desired bin 78 in conformity with the mode (the sort mode, the group mode or the continuous mode) selected by the sort mode key 160.

Then the second sorter 2B is installed as an additional one of the first sorter 2A in order to basically sort out more printed sheets P. The printed papers P are conveyed to the second sorter 2B by switching the sorter switching plate 110 of the first sorter 2A over to the sorter passage conveyer unit side, whereby the printed sheet P is conveyed via the sorter passage conveyer unit 102 to the following-state second sorter 2B before being inserted in the corresponding bin 78 as in the first sorter 2A.

Thus, the printed paper P is inserted in the sorter 2 (2A or 2B) in accordance with the mode (the sort mode, the group mode or the continuous mode) selected by the sort mode key 160.

Figure 10:
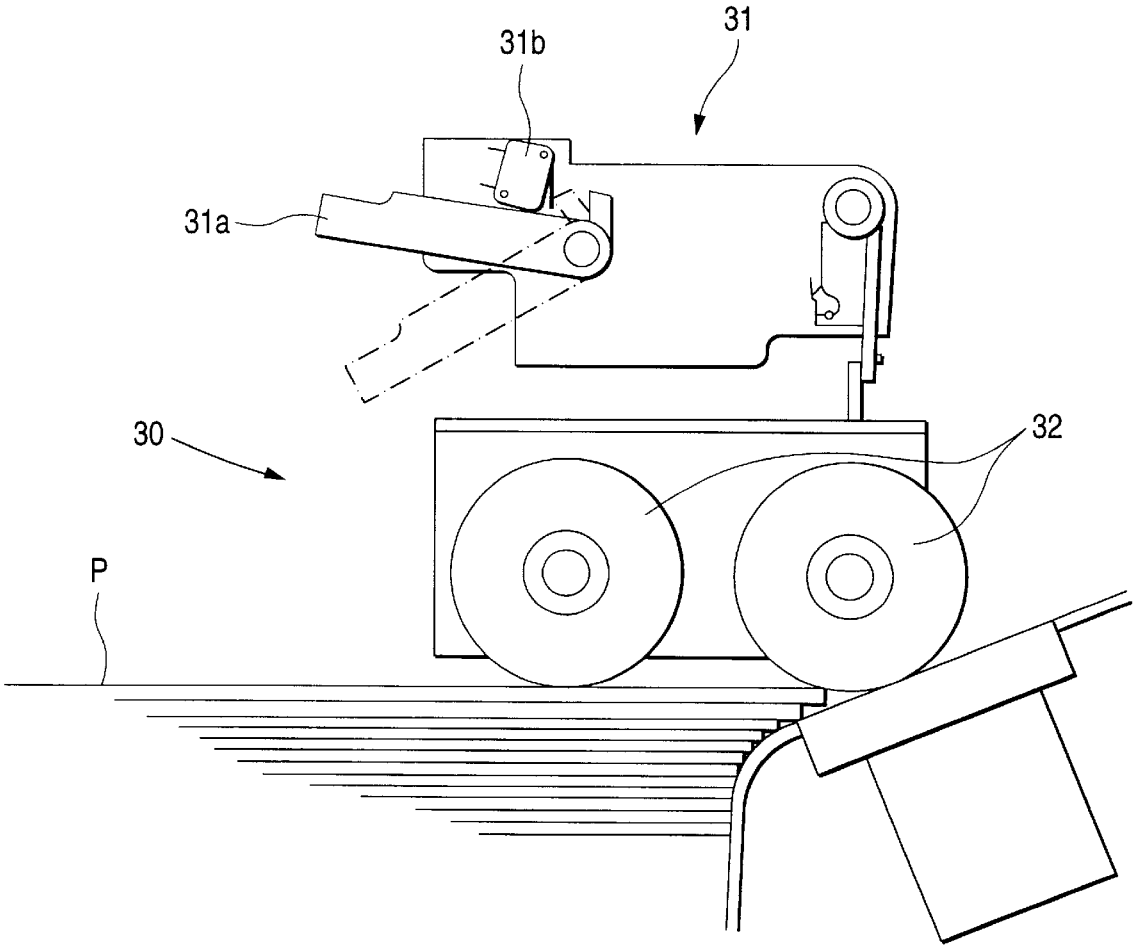
FIG. 10 is a block diagram of a sheet feed mechanism, in place of the operating panel, for setting different kinds of printing sheet in the image forming apparatus of the invention.

In this embodiment, the operating panel 146 is used to set one type of printing paper to determine the start position of the working bin 78, the different types of printing paper in terms of their thickness are not limited to 'standard', 'thick paper' and 'especially thick paper' but may include other kinds of thickness to be allocated. At this time, it is unnecessary to allocate a key to each kind of thickness and provided a combination of keys can be set, a smaller number of keys may be used for setting more kinds of thickness. A sheet-feed-pressure varying mechanism shown in FIG. 10 may be used for setting the start position of the working bin 78.

The sheet-feed-pressure varying mechanism 31 is provided for the sheet feed mechanism 30 of the stencil printing machine 1 and fitted with a lever 31*a* for varying the sheet feed pressure in accordance with the thickness of the printing sheet P mounted on the sheet feed tray 28, and a microswitch 31*b* which is turned on and off as the lever 31*a* is turned.

In the sheet-feed-pressure varying mechanism 31, the lever 31*a* is situated (as shown by a solid line of FIG. 10) so as to turn off the microswitch 31*b* when the printing sheets P mounted on the sheet feed tray 28 are 'standard' in thickness. The lever 31*a* is also situated (as shown by a chain line of FIG. 10) so as to turn on the microswitch 31*b* when the printing sheets P mounted on the sheet feed tray 28 are 'thick.' Thus, information about the thickness of the printing sheets P is obtainable.

The control means 170 (or the control unit 176) sets the start position of the working bin 78 on the basis of the information concerning the thickness of the printing paper. When the microswitch 31*b* is held OFF, for example, the start position of the working bin 78 is set to the position b1 of the uppermost bin 78A, whereas when the microswitch 31*b* is held ON, with the total number of bins 78 being 50, the start position of the working bin 78 is set to the position b2 of the fifth bin lower than the uppermost bin 78A, for example.

Although the control of the start position of the working bin 78 is assumed on the basis of information on only the thickness of printing paper according to the aforesaid embodiments of the invention, the control thereof may be effected on the basis of information on the density of printing paper (mass per unit area). In this case, the greater the density of printing paper, the lower the start position of the working bin 78 is set than the uppermost bin 78A, whereby the indexer 116 is so controlled as to move with the set start position of the working bin 78 as a starting point. Further, the information for use in determining the start position of the working bin 78 may be information deriving from a combination of thickness and density of printing paper.

In this embodiment, a stencil printing machine is used for an image forming machine of the image forming apparatus of the invention. However, various image forming machines, such as a copying machine, a printer and the like, may be used in the image forming apparatus of the present invention.

As is obvious from the description given above, printed sheets can be conveyed stably to and accommodated in the target bin, irrespective of the thickness of printing paper and the like, since the start position of the working bin is set according to the thickness and density of printed paper. Therefore, the paper jam percentage in the travel route of the printed sheet is reducible, which prevents not only printing sheet from being wasted but also the printing operation from being interrupted.

What is claimed is:

1. An image forming apparatus comprising:

image forming means for printing an image on a printing sheet;

a plurality of bins arranged in a vertical direction;

first conveyer means having a belt and suction means, for conveying the printed sheet discharged from the image forming means while air-drawing the printed sheet to the belt;

second conveyer means having suction means and a belt provided vertically along the plurality of bins and coupled to a downstream-side portion of the first conveyer means, for receiving the printed set conveyed by the first conveyer means and vertically conveying downward while air-drawing the printed sheet to the belt;

printed sheet guide means having a guide surface, being vertically movable along a sheet travel route of the second conveyer means, for peeling the printed sheet vertically conveyed downward by the second conveyer means off the belt of the second conveyer means with the guide surface and sending the printed set in either one of the plurality of bins;

control means for controlling driving the first conveyer means, the second conveyer means and the printed sheet guide means in accordance with the printed set discharged from the image forming means; and printing sheet information input means for inputting to the control means information on a thickness of printing sheet for use in the image forming means, wherein the control means sets a start position of a working bin out of the plurality of bins in response to the output of the printing set information input means.

2. The image forming apparatus according to claim 1, wherein the printing sheet information input means inputs a signal to said control means wherein the signal is switched on.off in accordance with a variation of pressure applied to the printing sheet, said variation of pressure being supplied to the image forming means in the form of said information on the thickness of the printing sheet.

3. The image forming apparatus according to claim 1, wherein the printing sheet information input means inputs a signal to the control means, said signal being given in accordance with the thickness of the printing sheet in the form of said information on the thickness of the printing sheet.

4. An image forming apparatus comprising:

image forming means for printing an image on a printing sheet;

a plurality of bins arranged in a vertical direction;

first conveyer means having a belt and suction means, for conveying the printed sheet discharged from the image forming means while air-drawing the printed sheet to the belt;

second conveyer means having suction means and a belt provided vertically along the plurality of bins and coupled to a downstream-side portion of the first conveyer means, for receiving the printed sheet conveyed by the first conveyer means and vertically conveying downward while air-drawing the printed sheet to the belt;

printed sheet guide means having a guide surface, being vertically movable up and down along a sheet travel route of the second conveyer means and for peeling the printed sheet vertically conveyed downward by the second conveyer means off the belt of the second conveyer means with the guide surface and sending the printed sheet in either one of the plurality of bins;

control means for controlling driving the first conveyer means, the second conveyer means and the printed sheet guide means in accordance with the printed sheet discharged from the image forming means; and printing sheet information input means for inputting to the control means information on a density of printing sheet for use in the image forming means, wherein the control means sets a start position of a working bin out of the plurality of bins in response to the output of the printing sheet information input means.

5. The image forming apparatus according to claim 4, wherein the printing sheet information input means inputs a key signal to the control means, said key signal being given in accordance with the density of the printing sheet in the form of said information on the density of the printing sheet.

6. A sorter for sorting a printed sheet discharged from an image forming machine, the sorter comprising:

a plurality of bins arranged in a vertical direction;

a conveyer provided vertically along the plurality of bins to convey the printed sheet vertically downward;

an indexer having a guide surface, being vertically movable along a sheet travel route of the conveyer, for peeling the printed sheet off the conveyer with the guide surface and sending the printed sheet in either one of the plurality of bins;

a controller connecting to the conveyer and the indexer, for issuing control commands to the conveyer and the indexer; and an operating panel connecting to the controller, wherein the operating panel receives a printing sheet information of the sheet to be printed and feeds the information to the controller, and the controller determines a start position of a working bin out of the plurality of bins in response to the information from the control panel.

7. The sorter according to claim 6, wherein the information of the sheet in the operating panel includes a thickness of the sheet to be printed.

8. The sorter according to claim 6, wherein the information of the sheet in the operating panel includes a density of the sheet to be printed.

* * * * *